US007677893B2

(12) United States Patent
Lvovskiy

(10) Patent No.: US 7,677,893 B2
(45) Date of Patent: Mar. 16, 2010

(54) TRAINING SIMULATOR FOR SHARP SHOOTING

(76) Inventor: Matvey Lvovskiy, 8750 Bay Pkwy., Apt. #D5, Brooklyn, NY (US) 11214

( * ) Notice: Subject to any disclaimer, the term of this patent is extended or adjusted under 35 U.S.C. 154(b) by 563 days.

(21) Appl. No.: 11/247,904

(22) Filed: Oct. 12, 2005

(65) Prior Publication Data

US 2007/0082322 A1 Apr. 12, 2007

(51) Int. Cl.
*F41G 3/26* (2006.01)

(52) U.S. Cl. ..... 434/21; 434/16; 434/17; 434/19; 434/23; 42/41; 42/42.02; 42/42.03

(58) Field of Classification Search ..... 434/16, 434/19, 21, 23
See application file for complete search history.

(56) References Cited

U.S. PATENT DOCUMENTS 3,849,910 A * 11/1974 Greenly ..... 434/22
3,888,022 A 6/1975 Pardes et al.
3,964,178 A 6/1976 Marshall et al.
3,996,674 A * 12/1976 Pardes et al. ..... 434/22
4,102,059 A * 7/1978 Kimble et al. ..... 434/22
4,137,651 A 2/1979 Pardes et al.
4,163,328 A 8/1979 Sherburne et al.
4,163,557 A * 8/1979 McLellan ..... 463/52
4,183,534 A * 1/1980 Simpson et al. ..... 273/358
4,223,454 A * 9/1980 Mohon et al. ..... 434/20
4,336,018 A * 6/1982 Marshall et al. ..... 434/22
4,640,514 A 2/1987 Myllya et al.
4,898,391 A * 2/1990 Kelly et al. ..... 463/5
5,366,229 A 11/1994 Suzuki
5,581,898 A * 12/1996 Thummel ..... 42/117
5,591,032 A 1/1997 Powell
5,816,817 A * 10/1998 Tsang et al. ..... 434/22
6,019,681 A * 2/2000 Oishi et al. ..... 463/49
6,295,753 B1 * 10/2001 Thummel ..... 42/116
6,322,365 B1 11/2001 Shechter et al.
6,550,175 B2 * 4/2003 Parker ..... 42/70.07
6,575,753 B2 6/2003 Rosa et al.
6,942,486 B2 9/2005 Lvovskiy
2002/0051953 A1 * 5/2002 Clark et al. ..... 434/16
2003/0175661 A1 * 9/2003 Shechter et al. ..... 434/19
2003/0195046 A1 * 10/2003 Bartsch ..... 463/49
2005/0181335 A1 * 8/2005 Lvovskiy ..... 434/16
2005/0188580 A1 * 9/2005 Jewell ..... 42/69.02
2006/0265929 A1 * 11/2006 Haney ..... 42/116

* cited by examiner

*Primary Examiner*—Cameron Saadat
*Assistant Examiner*—Bruk A Gebremichael

(57) ABSTRACT

The present invention relates to training simulators for sharp shooting and introduces a number of functionalities that provide significant savings and further efficiencies such as usage of actual unmodified combat firearms for training purposes, simultaneous training of two individual shooters with individual identification and result display of the firing activity from each shooter on a computer generated concentrical target analogous to the ones used today in firearm training facilities, as well as the usage of a specialized weapon trigger contactor which is mounted on the actual weapon and that provides the usage functionalities to allow training on all single, and double action pistols as well as fully automatic weapons. The simulator also incorporates an emitting unit consisting of a laser light diode and the associated mounting mechanisms which allow the mounting of the emitting unit on any standard firearm. The training simulator is designed to provide high levels of accuracy of the registration of shots fired from any shooter with the use of a TV camera and a system of mirrors and other optical and electrical devices.

6 Claims, 7 Drawing Sheets

TRAINING SIMULATOR FOR SHARP SHOOTING

BACKGROUND OF THE INVENTION

The present invention, a laser training simulator is primarily used to obtain and maintain high levels of marksmanship without the usage of real projectiles from all types of firearms including but not limited to bazookas. The usage of the training simulator provides substantial cost savings by significantly decreasing the demand for specialized gun training ranges, transportation of the trainees to and from the gun training facilities, as well as provides considerable economy of ammunition costs. The simulator's training process environment closely resembles circumstances that may arise in real life situations.

Training simulator provides the following training modes:

Static target shooting;

Dynamic target shooting with target traveling with varying speeds and varying trajectories;

Dynamic target shooting with disappearing and reappearing target behavior;

Search, acquisition, and reacquisition of a static or a dynamic target, which moves around virtually generated images of real time environments.

The present training simulator allows for further introduction of new training modes as well as adjustment of the existing training modes with respect to the professional requirements of the trainees. The training simulator allows trainees to master weapon grip, target acquisition, aiming and pulling the firearm's trigger, analogous to that of firing a combat weapon.

A number of existing patents disclose various training simulators which serve analogous purpose. Those patents include U.S. Pat. Nos. 3,888,022; 3,964,178; 4,137,651; 4,163,328; 5,366,229; 6,575,753.

The above mentioned patents however, carry a number of significant limitations and shortcomings which include: limited amounts of training modes, the necessity to employ firearm models which only remotely resemble the actual firearm or usage of standard firearms with significant modifications. Further shortcomings include: absence or insufficient ability to display accumulated and ongoing results of shots fired, existence of uncompensated methodical errors arising from incongruity of weapon mounted laser emitter's optical axis and the weapon's sight marker's line of aiming, as well as the incapacity to provide augmentation of training modes and reprogramming. In addition, the training simulators described in the above mentioned patents only support training a single simultaneous shooter.

The closest match to the present training simulator with respect to functional, constructive and tactical capabilities is U.S. Pat. No. 6,942,486 titled Training Simulator For Sharp Shooting, issued to Matvey Lvovskiy. The design of this training simulator fully eliminates or minimizes all of the aforementioned limitations and shortcomings. In addition to unlimited tactical capabilities, the training simulator under U.S. Pat. No. 6,942,486 allows for utilization of standard combat firearms with especially redesigned magazines for automatic and sniper rifles, as well as all types of handguns. The training simulator under U.S. Pat. No. 6,942,486 also provides vertical correction of the methodical error arising from incongruity of laser emitter's optical axis and the sight marker's line of aiming. Further, the training simulator under the U.S. Pat. No. 6,942,486 provides capability to train only one simultaneous shooter

SUMMARY OF THE INVENTION

The present training simulator for sharp shooting provides:

The ability to train 2 simultaneous shooters under all training modes with the introduction of a specialized system which differentiates firing activity of each shooter.

The ability to display the results of shots fired in a session on dual computer generated concentrical targets or a single combined target, similar to standardized paper based targets, and which is projected onto the screen by a video projector by the means of introduction of a detector into the optical unit of the training simulator. The detector consists of a digital device which transforms a television signal from the endpoint of a TV camera into rectangular axis plane (x,y) coordinates of the shot fired indication mark (which is formed on the screen with the activation of the weapon mounted laser light diode), from the TV camera measuring axis. The last then in digital format enters a computer.

The ability to implement a single downsized universal emitting unit on all firearms ranging from 5.4 mm to 10 mm in caliber and beyond, which with the use of a universal mounting mechanism mounts inside the barrel of a firearm.

Added precision in alignment of the emitting unit's laser beam travel path with the weapon sight marker's line of aim, thus achieving higher registration accuracy of shots fired by the trainee, by the means of utilizing a specialized mechanism, which allows elimination of methodical and instrumental angular aiming errors under two mutually perpendicular planes.

The ability to use any standard single and double action pistols and other firearms including automatic weapons for training purposes regardless of a cocking and trigger mechanism design and without any modifications to the weapon.

BRIEF DESCRIPTION OF DRAWINGS

A more complete appreciation of the subject matter of the present invention and the various advantages thereof can be realized by reference to the following detailed description in which references are made to the accompanying drawings in which.

DETAILED DESCRIPTION OF THE PREFERRED EMBODIMENT OF THE INVENTION

Figure 1:
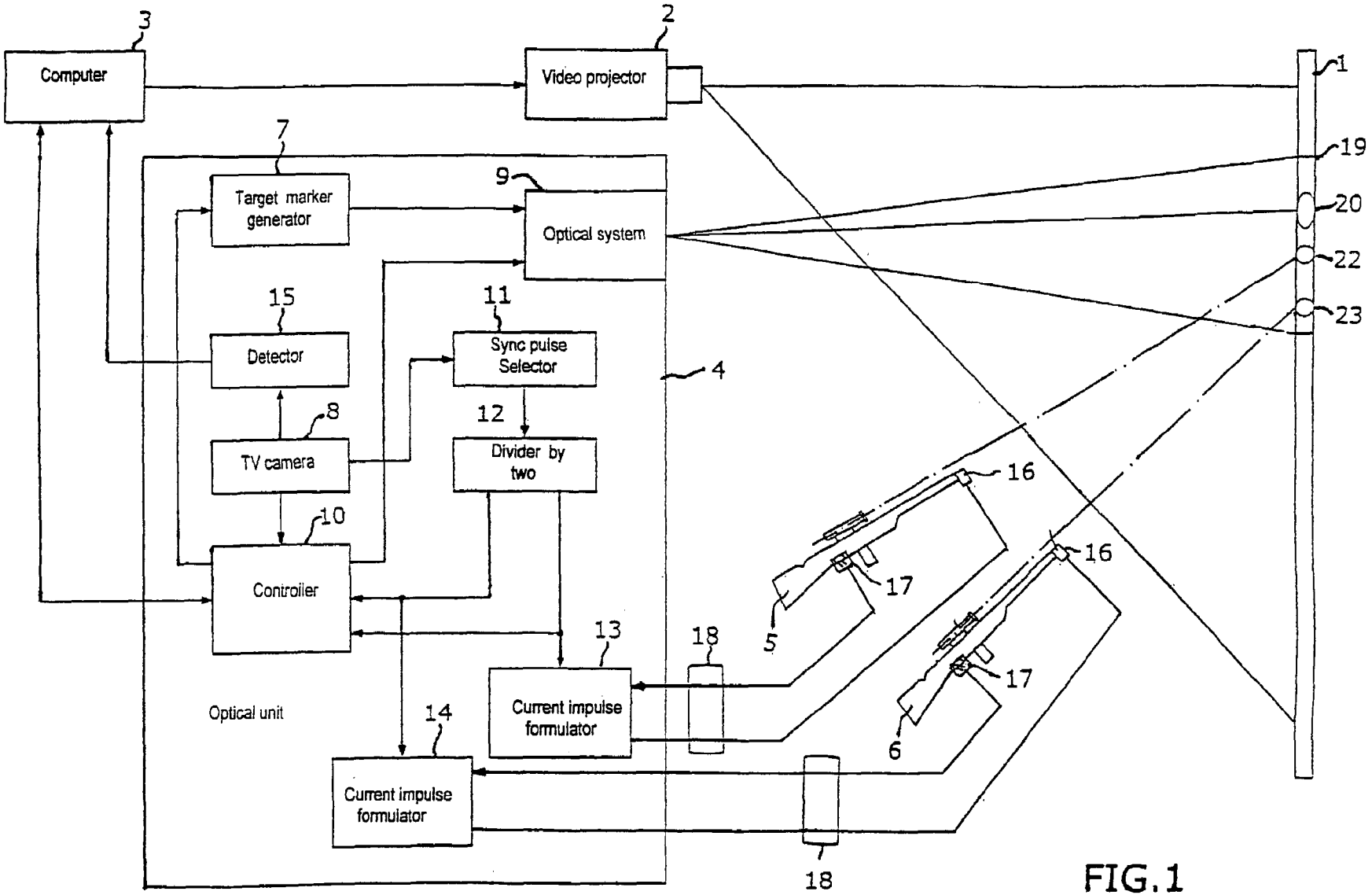
FIG. 1 shows a structural diagram of the training simulator which provides the ability to train 2 simultaneous shooters.

FIG. 1 displays a structural diagram of the training simulator which possesses the capability to train one or two simultaneous shooters with immediate result indication. The Training Simulator uses a screen 1, video projector 2, computer 3, optical unit 4, optical unit of weapon one 5, optical unit of weapon two 6. Each weapon utilizes a universal emitting unit 16, and a trigger contactor 17. In the universal emitting unit device, laser light diode is used.

Figure 7:
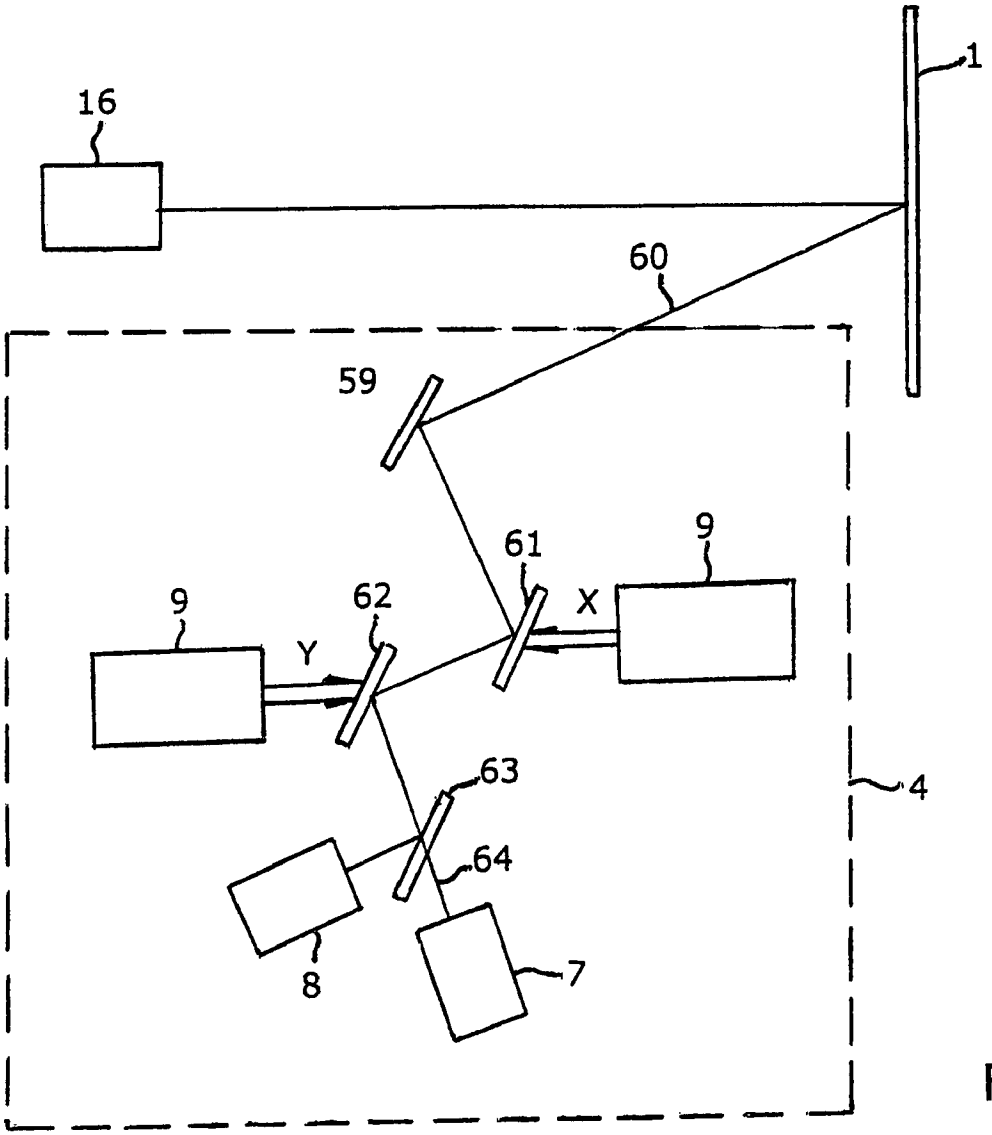
FIG. 7 shows an optical diagram of the optical unit.

Optical unit 4 includes target marker generator 7, TV camera 8, optical system with servos 9, and a controller 10. Optical diagram of the optical unit 4 is shown on FIG. 7. The diagram displays a fixed mirror 59, which receives the laser beam 60 that is being reflected off the screen and which is sent to the screen by the emitting unit 16, two rotating mirrors 61 and 62 which are brought to motion under mutually perpendicular axis (x, y) with the use of two servos 9, light divider 63 possessing selective attributes. Light divider 63 is mounted at a 45 degree angle with respect to the optical axis of the target marker generator 7 and TV camera 8. Selective attributes of the light divider amount to the ability to reflect approximately 70% of laser light emitted by the laser diode from the emitting unit 16 which is received by the TV camera 8, as well as the ability to pass approximately 70% of the light beam 64, which is created by the target marker generator 7.

In order to provide simultaneous training of two shooters with a single training simulator allowing full differentiation of the firing activity from each shooter, the optical unit 4 is enhanced with the following electrical devices:

- Synchronous Impulse Selector 11, which parses framed synchronous impulses exiting the TV camera 8.
- Frame frequency divider by two 12.
- Current impulse formulator 13, which powers the laser light diode of weapon one.
- Current impulse formulator 14, which powers the laser light diode of weapon two.

Entry point of synchronous impulse selector 11 is connected with the endpoint of the TV camera 8. Endpoint of synchronous impulse selector 11, is connected with the entry point of the frame frequency divider by two 12. First endpoint of the frame frequency divider by two 12, is connected to the first entry point of the current impulse formulator 13 and the corresponding entry point of the controller 10. The second endpoint of the frame frequency divider by two 12 is connected with the entry point of the current impulse formulator 14, and is also connected with the corresponding entry point of the controller 10. Secondary signal entry points of the current impulse formulator are connected with contactors 17, which are mounted on weapon 5 and 6. The endpoints of each of the current impulse formulators are connected with the laser diodes of the corresponding emitting units 16.

To display the results of shots fired on the computer 3 synthesized target, similar to the standardized paper targets and which is projected onto a screen 1, by the video projector 2, the optical unit 4 is equipped with the detector 15. The detector is a digital device which transforms the TV signal exiting the TV camera into rectangular digital coordinates of the deviated from the TV camera axis, shot marker (light marker which appears on the screen after the activation of the laser diode), which then enter the computer.

Detector 15 provides automatic alignment of the TV channel axis with the center of the marker display, which is needed in order to achieve the required registration precision of the shots fired. After activation of the Training Simulator with the usage of appropriate software, the detector 15 calculates the DX and DY coordinate deviation from the television raster center, which is located on the measuring axis of the TV camera, from the center of the target marker, which then in digital format enters the computer. These coordinates in the form of corrections with corresponding signs enter into calculated coordinates of a hit. This approach eliminates the potential errors that may occur from improper TV camera axis alignment with the center of the light target marker. The same corrective functionality can also be performed automatically by way of proportional displacement of the TV camera raster in a predefined manner, which provides the axis of the TV-camera to correspond with the raster's center as well as the center of the light target marker. The correction can then be repeated throughout the training session process to ensure continuous accuracy.

Additional electronic devices incorporated into the optical unit such as: synchronous impulse selector 11, frame frequency divider by two 12, current impulse formulators 13 and 14, and detector 15 in interaction with components of the optical unit 4, and computer 3, allow for identification of the shots fired from both firearms as well as accurately identify results of the firing on the concentrical targets projected on the screen.

Figure 2:
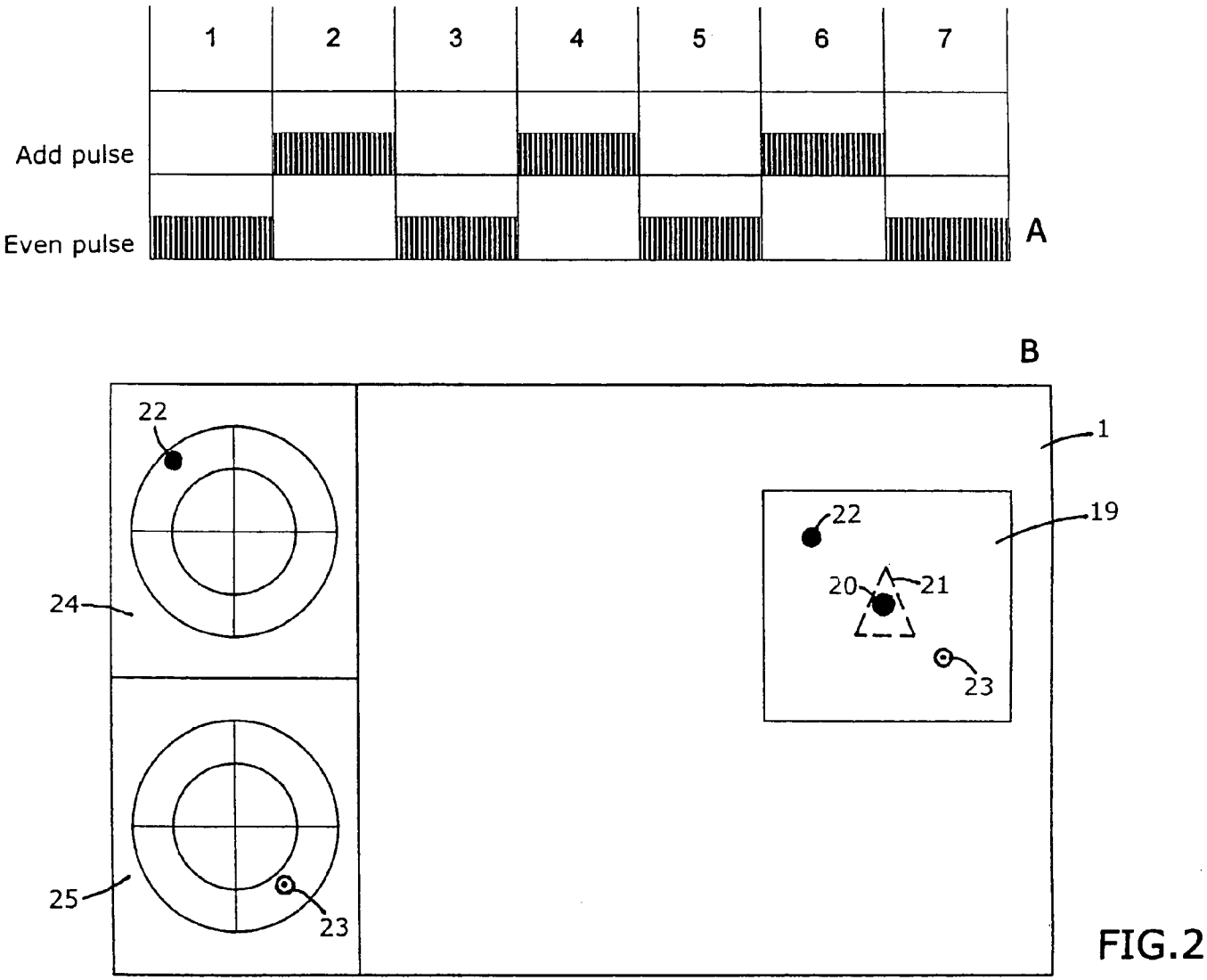
FIG. 2 shows a timing diagram of the current formulation impulses that are required to power the laser emitters with direct correspondence to the field number of the TV-Camera (A) as well as the result indication of shots fired by each shooter.

The above stated is achieved as follows (see FIG. 1). From the signal which is created by TV camera 8, synchronous impulse selector 11 generates frame synchronization impulses, which are directed towards the entrance of the frame frequency divider by two 12. The frame frequency divider by two creates odd and even impulses, which in turn enter the current impulse formulator 13 and 14. FIG. 2 (A) displays a timing diagram illustrating the formulation of odd and even impulses. If the frequency of the fields (frames) of the TV camera –f, then each of the two current impulse formulators receive impulses with the frequency f/2, however shifted with respect to each other of time t=1/f.

The activation of a trigger and activation of the trigger contactor 17 (FIG. 1, FIG. 3) creates a "START" signal that is generated and on the endpoint of the current impulse formulator causes the current impulses required to power the laser diodes. It is necessary to mention that while the odd field is active, the TV camera sees the light marker from laser diode of weapon 5, and while the even field is active, the TV camera sees the light marker form laser diode of weapon 6.

FIG. 2 (B) displays the method of indication of shots fired from two simultaneous shooters. Screen 1 shows the following: assumed TV camera visibility range boundaries 19, target marker 20 and target object 21, which moves about the screen under a given algorithm and is in direct synchronization with the target marker, shot fired indication mark 22 from weapon 5, shot fired indication mark 23 from weapon 6 which corresponds with concentrical targets 24 and 25 which indicate the results of shots fired from each shooter.

Light beams which are formed from laser diodes are reflected off the screen and enter the receiver of the TV camera 8. Television signal from the camera exit travels to the receiving end of the detector 15 which transforms the television signal into the rectangular axis plane (X,Y) coordinates. The coordinates are then displayed on corresponding concentrical targets identical to the standardized targets currently utilized in firearm training facilities. As an alternative, both concentrical targets can be incorporated into a single concentrical target. In this case, shot fired indication marks will have to be differentiated by employing either various shapes or colors. In order to allow both options, the computer 3 through controller 10 receives odd and even synchronized frame impulses.

The connectivity between the optical unit 4 (FIG. 1) with emitting unit 16 and trigger contactors 17 which are mounted on weapons 5 and 6, is accomplished with the usage of two identical flexible cables 18, comprising of 3 wires. One of the wires carries the "START" signal which is commenced upon contact of the trigger contactor with the weapon's trigger. The second "power" wire carries the impulses of electrical current to the laser diode of the emitting unit 16, and the third wire connects the casing of the emitting unit with the casing of the optical unit (not showed on FIG. 1).

Figure 3:
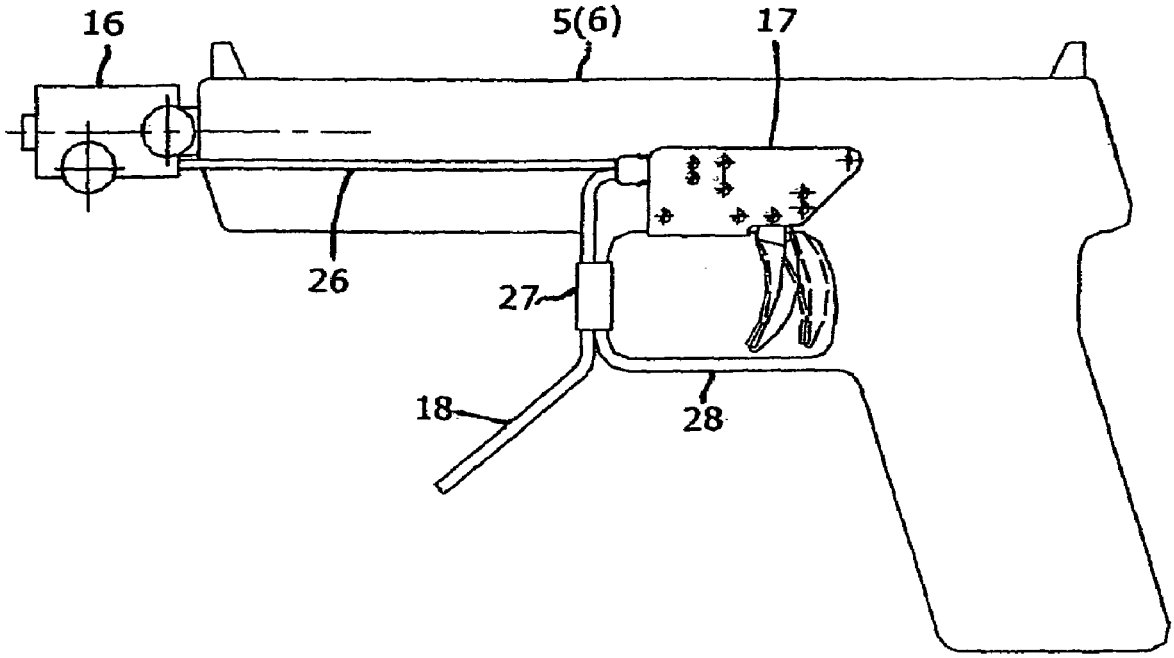
FIG. 3 shows firearm mounting of the emitting unit, weapon trigger contactor, and cable connectivity to the optical unit.
Figure 4A:
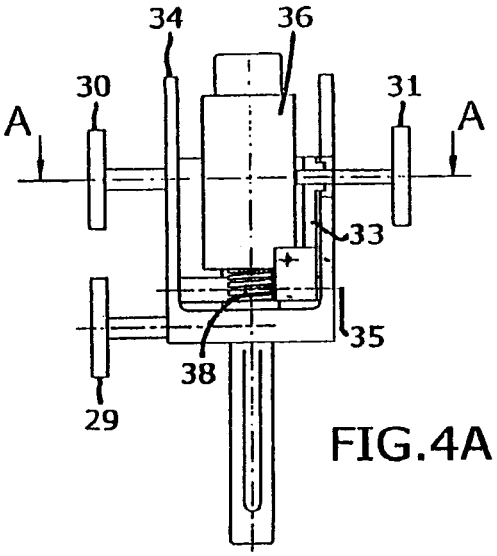
FIG. 4 shows a functional diagram of the emitting unit's optical beam travel alignment mechanism.
Figure 4B:
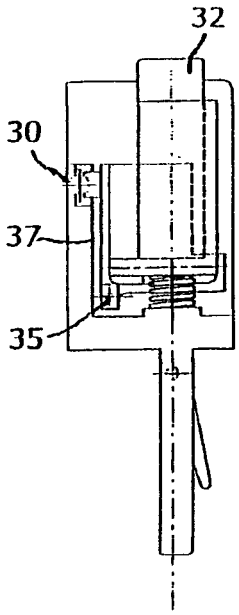
Figure 4C:
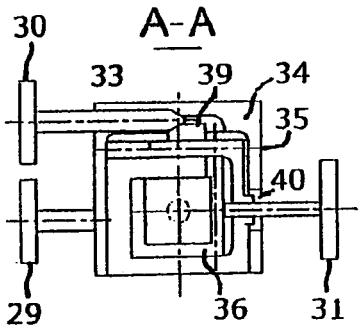
Figure 4D:
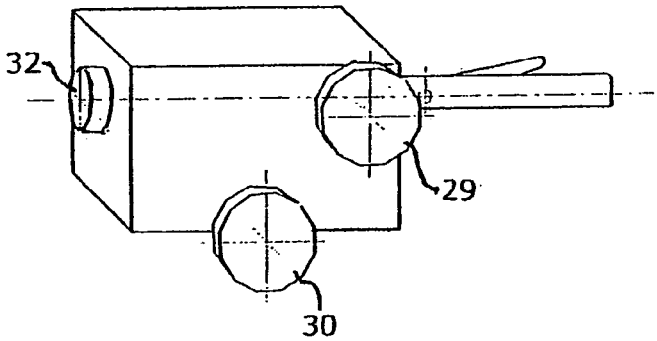

FIG. 3 shows the positioning of the universal emitting unit 16 and trigger contactor 17 on the firearm. The emitting unit and the trigger contactor are constructed to be fully autonomous circuits. The mounting and dismounting of the emitting unit and the trigger contactor onto and from the firearm can be accomplished by the trainee in the matter of seconds, and does not require usage of any specialized tools. This solution can be implemented without any modification to the actual firearm, meaning that any standard firearm which may or may not currently be used by the military, police departments and other organizations can be utilized for training purposes. The connectivity between the emitting unit and the trigger contactor is accomplished by utilization of cable 26. The connectivity between the trigger contactor and the optical unit is accomplished with the use of cable 18, while cable 18 with the use of a firm bracket 27 is attached to the bezel 28.

FIG. 4 shows a diagram of the optical axis adjustment mechanism for the laser diode located inside the emitting unit. The diagram displays the following:

- mounting screw 29, which provides mounting of the emitting unit on the firearm;
- adjustment screw 30, which provides vertical adjustment for the shot fired indication mark
- adjustment screw 31, which provides horizontal adjustment for the shot fired indication mark.

Angular adjustment of the laser light diode 32 by the means of two swinging arms pointing to mutually perpendicular directions allows full and independent adjustment. Arm 33 revolves around casing 34 on axis 35. Arm 36 revolves around the arm 33 on axis 37 of the perpendicular axis 35.

In the upper portion of the arm 36, a laser light diode 32 is situated. Lower (bottom) portion of the arm 36, is supported by the returnable spring 38 and the other ending of the returnable spring 38 pushes into the "shelf" of the emitting unit's casing. Axis of the spring 38 is aligned with the axis of the laser light diode 32, while axis 35 and 37 are shifted with respect to the returnable spring 38, allowing the spring to simultaneously provide pressure of the arm 36 to the pushing screw 31, as well as pressure of the wedge overlay 39 which is mounted on the arm 33, to the conical side of the screw 30. The spring 38 sustains pressure adequate to allow for smooth and seamless adjustments. Screw 30 revolves inside the grooved aperture of the emitting unit's casing 34, and screw 31 revolves inside the grooved aperture of the arm 33. Since adjustment with screw 30 also causes screw 31 to swing together with arm 33, a correctly sized aperture 40 exists inside the emitting unit's casing 34.

The above mentioned optical axis attitude control mechanism of the laser light diode allows to eliminate methodical and instrumental aiming errors. The vertical errors arise from the fact that the firearm sight marker's aiming line does not correspond with the optical axis of the laser light diode, and at best, they may be parallel. For instance, in a sniper rifle the distance between the optical scope reticle aiming line traveling through the center of a human eye and the rifle's axis of the barrel is approximately 100 mm and more. In a case with a handgun, there is also a significant distance between the sight markers aiming line passing through the center of a human eye and the axis of a barrel. In the horizontal plane, similar inaccuracies and errors can also be corrected.

The correction of the aforementioned errors and inaccuracies is performed by the method of calibration of the firearm which should be mounted on a firm base, such as a tripod. The calibration procedure is performed on a calibration reticle that is placed on screen 1. Throughout the calibration process, the laser diode is placed into a continuous light emitting state. To achieve accurate calibration, with the help of rotating screws 30 and 31, it is necessary to align the laser light beam and the sight marker's aiming line in the center of the calibration reticle. Once calibrated for a particular type of a weapon, the emitting unit can be used on any weapon belonging to that particular weapon type without further adjustments.

Figure 5A:
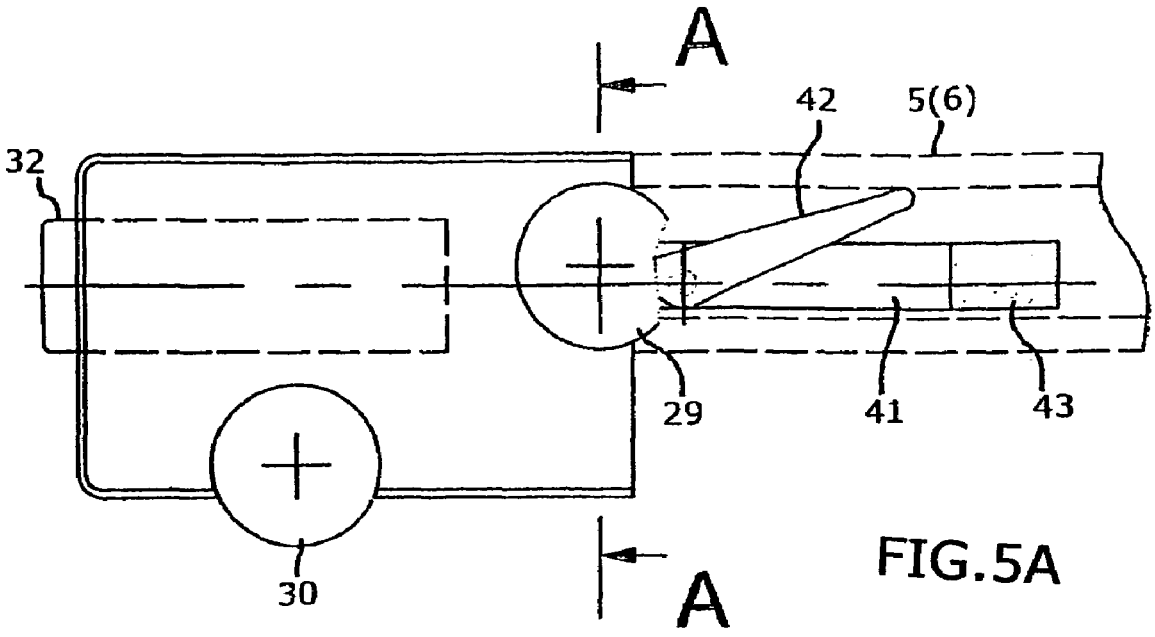
FIG. 5 shows a functional diagram of the emitting unit mounting inside the barrel of a weapon.
Figure 5B:
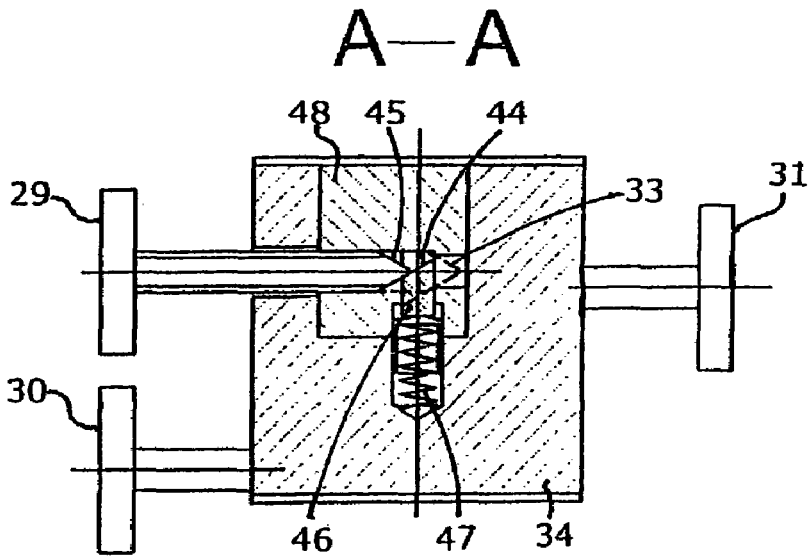
Figure 6A:
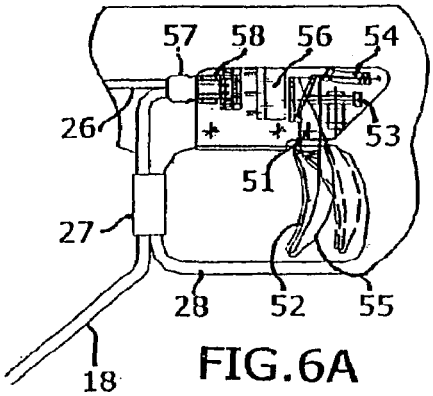
FIG. 6 shows a functional diagram of the weapon trigger contactor with weapon mounting elements.
Figure 6B:
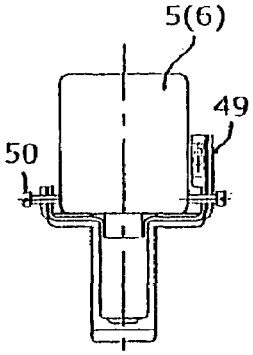
Figure 6C:
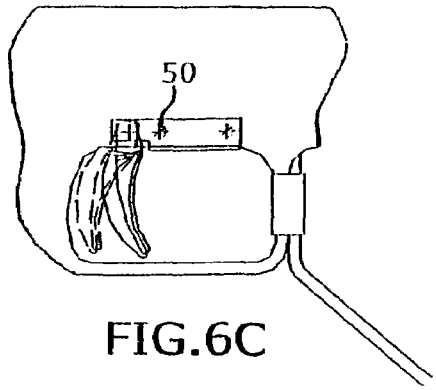
Figure 6D:
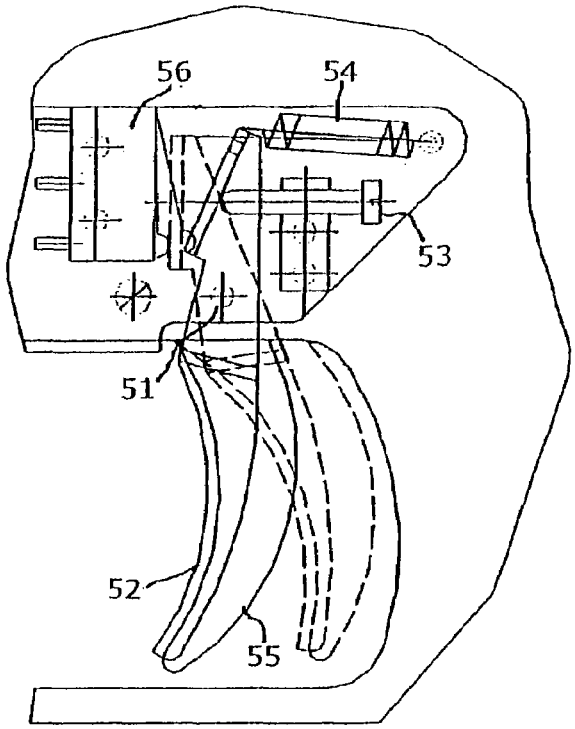

FIG. 5 shows a constructive mounting diagram of the emitting unit inside a weapon's barrel. The mounting is accomplished by guider 41 of the emitting unit casing 34, and adjustable lever 42. The lever is positioned inside a groove of the guider and on the rotational axis. The pressing of the lever 42 and the side cuts 43 of the guider 41 to the cylindrical surface of the barrel is achieved with the use of screw 29 and utilizing the principal of wedge clasping allows positioning of the screw 29 horizontally, where it does not obstruct the aiming line of sight.

The diagram of the wedge clasp is shown on FIG. 5 A-A. Screw 29 employs a conical endpoint 44, which presses on the inclined edge 45 located at the rear of lever 42. The process of securing the screw 29 causes it's conical edge to shift horizontally and also causes shifting of the lever downward, while the other side of the lever is forced to raise upward and press against the inside wall of the barrels in weapons 5 and 6. Simultaneously, lower edge 43 of the guider 41 is pressed against the wall of the barrel by so mounting and positioning the emitting unit inside the barrel. From underneath, the rear of lever 42 is supported by adapter 46 and spring 47. In order to provide for sustained durability, the duralumin inside of casing of the emitting unit contains a bronze shell 48 that contains a grooved aperture of screw 29 (steel), and vertical slot to provide gliding of the endpoint adapter of lever 29, as well as an aperture for traveling of adapter 46.

The architecture of the emitting unit is universal and can be mounted and installed in any firearm from 5.4 mm to 10 mm of caliber and more. With slight design modifications without changing core constructive principals, the emitting unit can be mounted on a weapon over 10 mm of caliber for use with the training simulator. This task can be accomplished by the introduction of an adapter containing a lever, which is brought to motion by lever 42 and by such analogous means allows for mounting of the emitting unit device with the mounting adapter inside of a firearm's barrel.

FIG. 6 shows an operational diagram of the weapon's trigger contactor. It contains a firm brace 49, which is mounted on weapon 5 and 6 with the help of four stop screws 50. On brace 49, with the help of two half-axis 51 a complexly shaped trigger imitator 52 is mounted. Upper part of the trigger imitator, in an idle position is pulled towards the adjustment screw 53 by the means of spring 54 while the lower part of the trigger imitator 52 makes contact with the firearm's actual trigger 55.

The pulling of the trigger imitator 52 causes its upper side to activate switch 56, and the release of the trigger imitator 52 returns the imitator and the switch to the deactivated state with or without firearm's actual trigger 55 depending on the weapon model and/or type. As it is known that some firearms being in the unloaded state lock the trigger after it is pulled once. Thus, the aforementioned technical solution allows for usage of any firearms for training purposes such as:

- Firearms with manual hammer cocking after each shot fired.
- Firearms with automatic hammer cocking after each shot fired.

Firm brace 49 and trigger imitator 52 are designed to be unsymmetrical. The right side of the firm brace 49 only contains stop screws 50 and half-axis 51. The left side of firm brace 49 contains screw 53, spring 54, switch 56, as well as miniature fork 57 and mounting rod 58. The contactor socket contains cable 26 which connects to the emitting unit 16, and cable 18 which connects to the optical unit 4. Cable 18 is also secondarily attached to the bezel 28 with the use of a firm bracket 27. For various weapon groups with similar trigger area sizes, trigger imitator contactors of corresponding fit can be manufactured and offered with the simulator as optional components.

ADVANTAGES OF THE INVENTION

The aforementioned technical solutions augment tactical, usable and informative functionalities of laser training simulator where:

- There is a significant increase in efficiency of the simulator which is especially important in field training environments. The added functionality to train two simultaneous shooters allows for introduction into the training process a competition factor which may contribute to higher quality training.
- The use of computer software providing visualization of the training process and related details such as: display results of shots fired on a computer generated concentrical target, as well as parallel indication of task time elapsed in digital format allows to administer integral analysis of each shooter and impose the required corrections into the training procedure. All stated contribute to the overall quality and professional suitability of the trainees.
- The ability to use standard firearms of all types including but not limited to: handguns, machine guns, sniper rifles, hunting and sporting weapons. The usage of the simulator requires absolutely no modifications of the actual firearms as well as eliminates the need for the creation of models or modified versions of the required training weapons.
- The introduction of a weapon trigger contactor which is mounted on the firearm allows for the activation of the laser light diode from the emitting unit regardless of the firearm's cocking mechanism. It can be used in all single and double action firearms with manual and automatic hammer cocking as well as fully automatic weapons.
- Emitting unit's small size, light weight and positioning of it outside the sight markers visual aim line do not affect the normal and natural handling of a weapon throughout the training process.
- The emitting unit and the weapon trigger contactor are quickly and easily mounted on a firearm. With proper instructions, the mounting procedure can be executed by the trainee.
- After the emitting unit calibration process which is required in order to eliminate instrumental and methodical angular errors, the emitting unit can be used on any firearm of the given type without further recalibration.
- The condition of precise alignment of the laser diode's optical axis with the sight marker's aiming line carries an important psychological factor. This factor stands for the shooter's ability for immediate visual identification of a result with respect to the shot fired (Hit or Miss) and in case of a miss, implement corrections in aiming.
- The emitting unit and the trigger contactor can be dismounted within seconds returning the firearm used for training purposes to its original state to be used with live ammo.
- For the purposes of training on the simulator, personal weapons can be used as well.

I claim:

1. Training Simulator for marksmanship firearms weapon training utilizing various types of real combat firearms without the usage of projectiles comprising a diffusive and reflective screen, computer, video projector, as well as a light emitting unit which is secured on a weapon and which incorporates a laser light emitting diode that generates laser light pulse upon the pull of a trigger, optical unit incorporating a set of mirrors with a single fixed mirror and two rotating mirrors that are brought to motion with the use of a servo, controller, optical target marker generator which represents the target image on the screen, light divider with selectivity characteristics, transmitting TV camera measuring axis of which is precisely aligned with the optical axis of target marker image generator as well as a detector, and which is distinguished by that:

- in order to provide augmented tactical and functional advantages by allowing simultaneous training of two individual shooters on either the same or two distinctive targets on the image projected onto the screen, the optical unit is equipped with a synchronous impulse selector as well as a generator of odd and even frames with both components subsequently used to produce power for the activation of the light emitting diodes which is housed by the light emitting unit;
- in order to identify with high levels of accuracy the screen positioning of the laser generated dot used to simulate a firing event relative to the center of the optical target marker generator, the Laser Training Simulator implements automatic calibration of shifting of the TV raster's center from the axis of the optical target marker generator;
- to utilize real combat firearms freed of ammunition including weapons with automatic cocking recess for marksmanship training, a removable trigger imitator is incorporated into the Training Simulator which installed and affixed onto the outer portion of the weapon's casing;
- for unification of the light emitting unit for all types of weapon, is further equipped with adjustable arrangement ensuring the installation and fixing onto weapons of various calibers.

2. The training simulator as in claim 1, distinguished by that in order to provide differentiation of firing events between two shooters, the synchronous impulse selector that is connected to the TV Camera and is also able to differentiate synchronous impulses of the frames and is further connected with the ingress end of the odd and even frames generator where frames are delivered to a first and a second current impulse formulators which upon receipt of the "start" signal that occurs during the weapon's trigger activation also generates current impulses that power the laser light emitting diode, while the transmitting TV Camera during the timing of the odd field acknowledges laser firing mark originating from weapon one and during the timing of the even fields acknowledges the laser firing mark of weapon two.

3. The training simulator as in claim 1, distinguished by providing correction of inaccuracies in identifying the coordinates of firing events due to the shifting of the television raster's center in relation to the axis of the optical light target marker generator by introducing shift distance values DX and DY that are used for the purposes of manual adjustment of the TV raster under vertical and horizontal coordinate plane axis.

4. The trigger imitator as in claim 1, whereas in order to provide proper mounting on a weapon, the trigger imitator is made in a bracket shaped form, is secured with the usage of screws on the firearm's exterior between the actual trigger bezel and the actual trigger, houses an electric switch, makes contact with the human finger, and also closely resembles that of a real firearm trigger, and further while in the idle state, the upper portion of the trigger is pulled towards a regulating screw, and when manual pressure is applied to the trigger imitator, its upper portion activates the electric switch.

5. The light emitting unit as in claim 1, distinguished by that to provide universal characteristics to the light emitting unit and the associated method of securing such inside the barrel of all types of firearms ranging from 5.4 mm to 10 mm without introduction of new or replacement of any existing components thereof, the light emitting unit is equipped with a securing mechanism comprised of an adjustment screw that rotates inside the unit's housing, as well as a guider which is inserted inside the barrel, and having an aperture which holds an adjustment lever the stub of which when brought in motion by the adjustment screw shifts downward by so pressing the other end of the lever and the guider base to the interior walls of the barrel, at the same time in order to ensure parallel alignment of the light emitting unit axis to weapon barrel axis, the guider base is provided with the flat cut the edges of which are positioned along the cylindrical surface of the barrel when it is affected by rotation of a stop screw.

6. The light emitting unit as in claim 5, distinguished by that in order to allow for the light emitting unit to be mounted into a barrel whose diameter exceeds 10 mm, is equipped with an adapter utilizing a lever and an inclined edge which is brought into motion by the main lever that allows for the emitter unit and the adapter to be secured inside the weapon's barrel.

* * * * *